US008596057B2

(12) United States Patent
Du

(10) Patent No.: US 8,596,057 B2
(45) Date of Patent: Dec. 3, 2013

(54) METHOD AND APPARATUS FOR CONTROLLING A VARIABLE DISPLACEMENT HYDRAULIC PUMP

(75) Inventor: Hongliu Du, Naperville, IL (US)

(73) Assignee: Caterpillar Inc., Peoria, IL (US)

( * ) Notice: Subject to any disclaimer, the term of this patent is extended or adjusted under 35 U.S.C. 154(b) by 1031 days.

(21) Appl. No.: 12/573,949

(22) Filed: Oct. 6, 2009

(65) Prior Publication Data

US 2011/0079006 A1 Apr. 7, 2011

(51) Int. Cl.
*F15B 13/044* (2006.01)
*E02F 9/22* (2006.01)

(52) U.S. Cl.
USPC ..... 60/443

(58) Field of Classification Search
USPC ..... 60/443, 444; 92/12.1, 13
See application file for complete search history.

(56) References Cited

U.S. PATENT DOCUMENTS

| | | | | | |
|---|---|---|---|---|---|
| 3,252,426 | A * | 5/1966 | Parr | 417/222.1 |
| 4,282,711 | A * | 8/1981 | Branstetter | 60/444 |
| 4,381,702 | A * | 5/1983 | Myers | 60/443 |
| 4,478,136 | A * | 10/1984 | Heiser et al. | 60/444 |
| 4,487,109 | A | 12/1984 | Burandt et al. | |
| 4,510,750 | A | 4/1985 | Izumi et al. | |
| 4,640,095 | A * | 2/1987 | Engel et al. | 60/443 |
| 4,801,247 | A | 1/1989 | Hashimoto et al. | |
| 4,802,336 | A * | 2/1989 | Mayr et al. | 60/443 |
| 5,138,838 | A | 8/1992 | Crosser | |
| 5,881,629 | A | 3/1999 | Gollner et al. | |
| 6,010,309 | A | 1/2000 | Takamura et al. | |
| 6,468,046 | B1 | 10/2002 | Du et al. | |
| 6,623,247 | B2 * | 9/2003 | Du | 91/505 |
| 6,684,636 | B2 | 2/2004 | Smith | |
| 6,725,131 | B2 | 4/2004 | Lunzman | |
| 6,837,046 | B2 * | 1/2005 | Gollner | 60/443 |
| 6,848,254 | B2 | 2/2005 | Du | |
| 6,883,313 | B2 | 4/2005 | Egelja et al. | |
| 6,901,315 | B2 | 5/2005 | Kockemann | |
| 6,939,261 | B1 * | 9/2005 | Pollman | 475/72 |
| 7,086,225 | B2 * | 8/2006 | Kadlicko | 60/443 |
| 7,130,721 | B2 | 10/2006 | Wear et al. | |
| 7,243,492 | B2 * | 7/2007 | Niidome et al. | 60/443 |
| 7,849,686 | B2 * | 12/2010 | Nielsen | 60/443 |
| 2002/0176784 | A1 | 11/2002 | Du | |
| 2009/0005914 | A1 | 1/2009 | Demarco | |

FOREIGN PATENT DOCUMENTS

| | | |
|---|---|---|
| JP | 2005201076 | 7/2005 |
| KR | 100264281 | 8/2000 |
| KR | 200407224 | 9/2006 |
| KR | 100773987 | 11/2007 |

* cited by examiner

*Primary Examiner* — Thomas E Lazo
(74) *Attorney, Agent, or Firm* — Miller, Matthias & Hull

(57) ABSTRACT

A control system for a variable displacement hydraulic pump is disclosed. The control system utilizes two flow control valves to provide a flow of hydraulic fluid to two control actuators. The control actuators create opposing moments on the pump swashplate to control swashplate orientation and pump displacement.

15 Claims, 5 Drawing Sheets

METHOD AND APPARATUS FOR CONTROLLING A VARIABLE DISPLACEMENT HYDRAULIC PUMP

TECHNICAL FIELD

This disclosure relates generally to a method and apparatus for controlling an angle of a swashplate pivotally attached to a variable displacement hydraulic pump and, more particularly to a method an apparatus for controlling the swashplate of an over-center pump.

BACKGROUND

Variable displacement hydraulic pumps are widely used in hydraulic systems to provide pressurized hydraulic fluid for various applications. Many types of machines such as dozers, loaders, and the like, rely heavily on hydraulic systems to operate, and utilize variable displacement pumps to provide a greater degree of control over fixed displacement pumps.

Various control schemes have been utilized to control the swashplate angle of such variable displacement hydraulic pumps. One such control scheme is disclosed in U.S. Pat. No. 6,623,247, filed May 16, 2001, to Hongliu Du. However, it may be beneficial to provide a responsive control scheme having over-center capabilities.

SUMMARY OF THE INVENTION

In a first aspect of the disclosure, a hydraulic system is provided having a variable displacement hydraulic pump having a swashplate rotatable about an axis; a first hydraulic actuator configured to rotate the swashplate a first direction about the axis; a second hydraulic actuator configured to rotate the swashplate a second direction about the axis; the second direction being opposite to the first direction; a first flow control valve configured to provide pressurized fluid to the first actuator; and a second flow control valve configured to provide pressurized fluid to the second actuator.

In another aspect of the disclosure, a method for controlling a swashplate orientation of a variable displacement hydraulic device includes a first step of configuring the variable displacement hydraulic device to act as a pump by directing pressurized fluid through a first flow control valve to a first control actuator to create a moment in a first direction on the swashplate. This method further includes a second step of configuring the variable displacement hydraulic device to act as a motor by directing pressurized fluid through a second flow control valve to a second control actuator to create a moment in a second direction on the swashplate, the second direction being opposite to the first direction.

DETAILED DESCRIPTION

Figure 1:
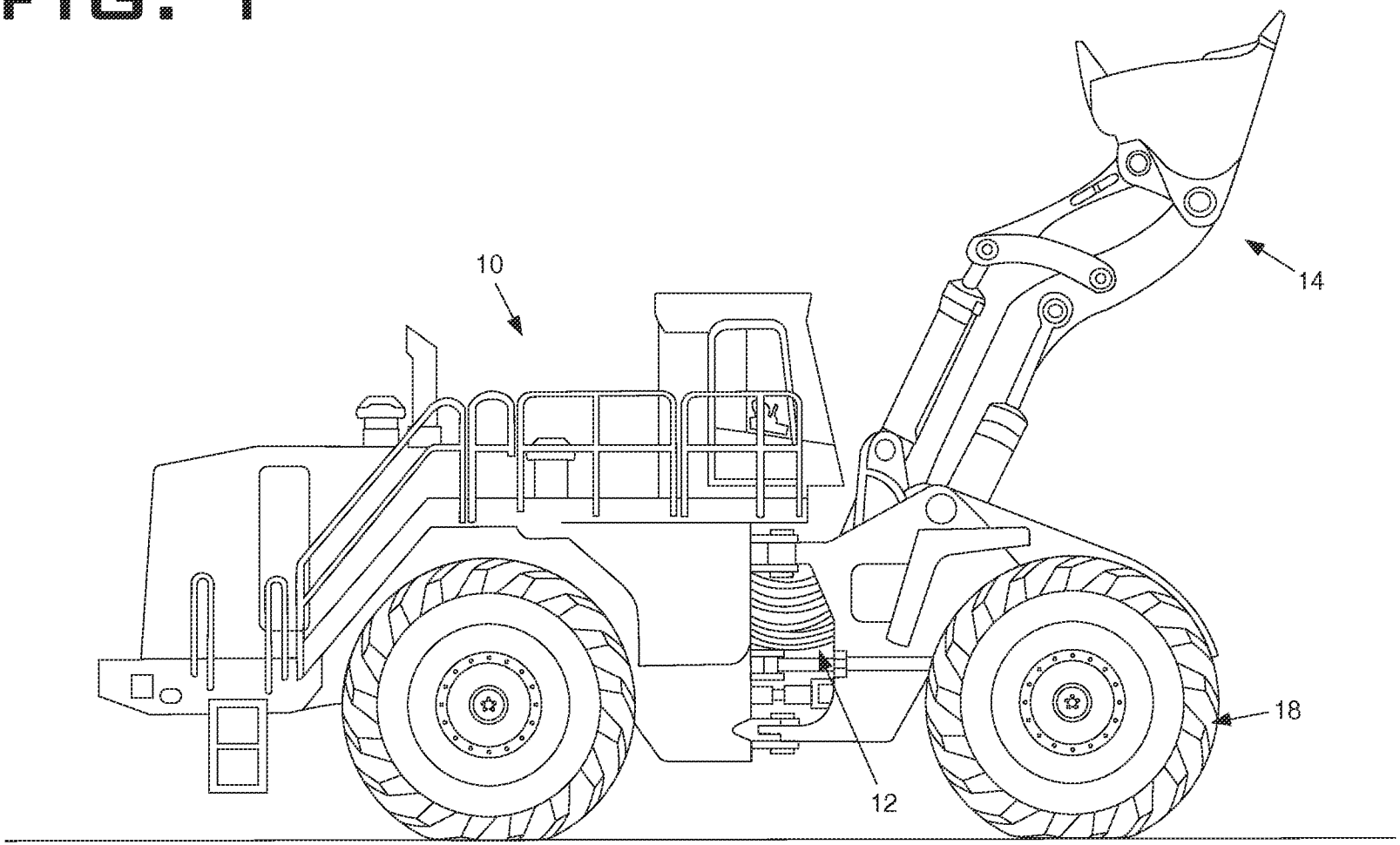
FIG. 1 is a side view diagrammatic illustration of an exemplary machine.
Figure 2:
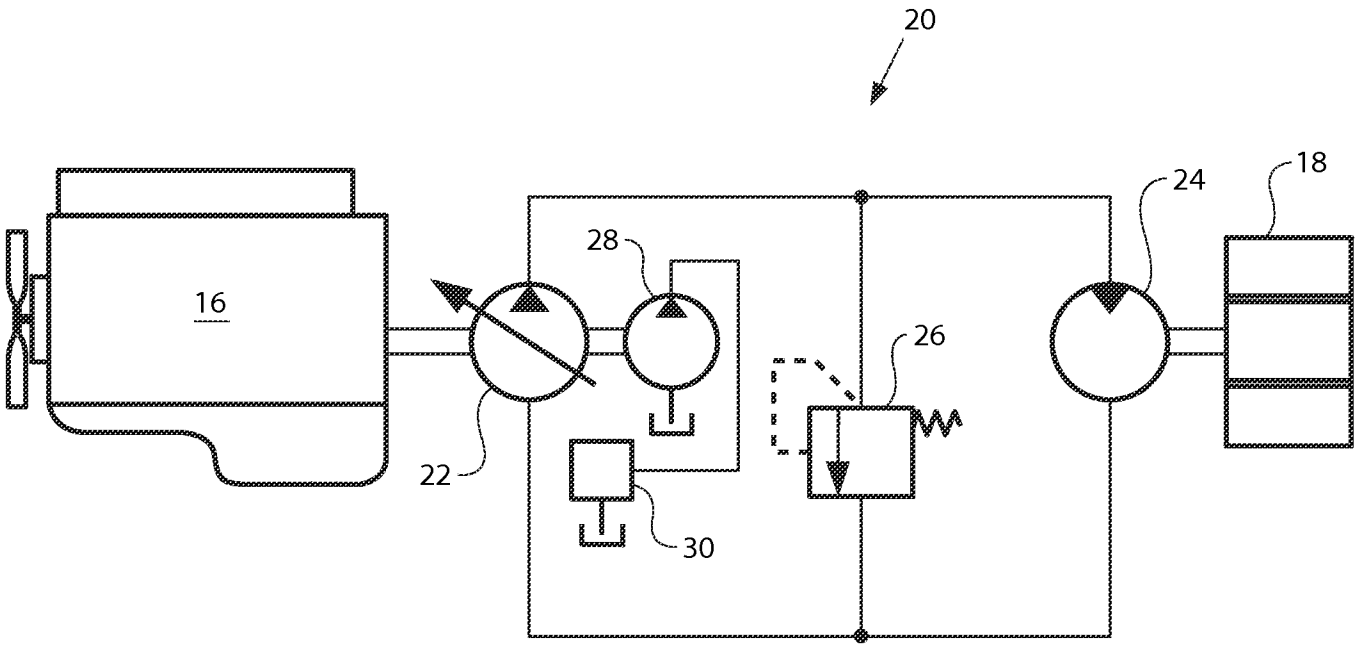
FIG. 2 is a schematic illustration of an exemplary transmission.

FIG. 1 illustrates an exemplary machine 10. Machine 10 may be a fixed or mobile machine that performs some type of operation associated with an industry such as mining, construction, farming, or any other industry. For example, machine 10 may be an earth-moving machine such as a dozer, a loader, a backhoe, an excavator, a motor grader, a dump truck, or any other earth-moving machine. Machine 10 may also include a generator set, a pump, a marine vessel, or any other suitable machine. Referring to FIGS. 1 and 2, machine 10 may include a frame 12, an implement 14, an engine 16, traction devices 18 such as wheels or a track, and a transmission 20 to transfer power from the engine 16 to the traction devices 18.

As illustrated in FIG. 2, the transmission 20 may, for example, be a hydrostatic transmission and may include a primary pump 22, a motor 24 and a bypass relief valve 26. According to the present disclosure, the main pump 22 may be a variable displacement pump such as a variable displacement axial piston pump, and the motor 24 may be a fixed displacement hydraulic motor. However, the motor 24 may alternatively be a variable displacement motor. The transmission 20 may further include a charge pump 28 providing pressurized fluid to swashplate control hardware 30, which is illustrated in greater detail in FIG. 3.

Figure 3:
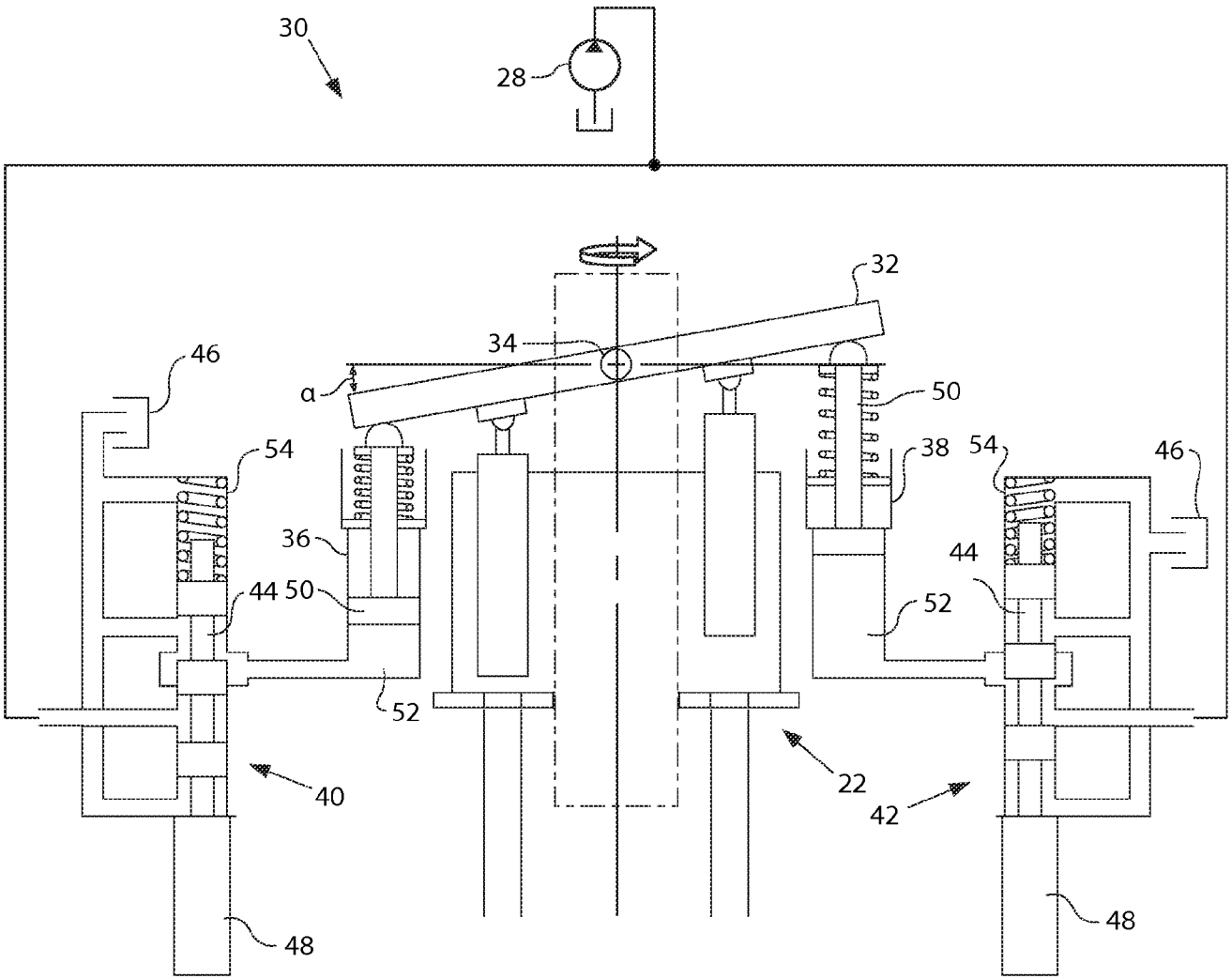
FIG. 3 is a schematic illustration of an exemplary pump and associated control hardware.

According to the embodiment in which the motor 24 is a fixed displacement motor, the speed and torque control of the transmission 20 may be accomplished, at least in part, by regulating the displacement of the pump 22. For a variable displacement axial piston pump, displacement is controlled by altering the angle of inclination of a swashplate 32, as illustrated in FIG. 3. FIG. 3 further illustrates control hardware 30 capable of controlling the angle of the swashplate 32.

As illustrated in FIG. 3, the swashplate 32 inclines about a swashplate pivot point 34. The swashplate 32 is actuated by two hydraulic control actuators 36, 38 configured to receive pressurized fluid, respectively, from two control valves 40, 42. In the illustrated embodiment, control valves 40, 42 are three-way flow control valves, functioning to control the flow of pressurized fluid between a source of pressurized fluid, control actuators 36, 38, and a low pressure reservoir, such as a tank 46. In the illustrated embodiment, the source of pressurized fluid is the charge pump 28.

Each control actuator 36, 38 may include a piston 50 disposed in a chamber 52. The pistons 50 apply a force on the swashplate 32. The forces applied by the two pistons 50 create opposing moments on the swashplate 32, and movement of the pistons 50 changes the inclination angle $\alpha$ of the swashplate 32. The swashplate angle $\alpha$ may be monitored by a swashplate angle sensor, as may be known in the art. Movement of the pistons 50 is effected by pressurized fluid entering and exiting the respective chambers 52. The flow of pressurized fluid into and out of the chambers 52 is controlled by the control valves 40, 42.

Control valves 40, 42 may be flow control valves having a spool 44 movable between a flow passing position allowing pressurized fluid to flow between charge pump 28 and a respective control actuator 36, 38, a flow blocking position which substantially hydraulically isolate the respective control actuator 36, 38 from both the charge pump 28 and the tank 46, and a drain position allowing fluid to flow from the respective control actuator 36, 38 to tank 46. Controls valves 40, 42 may also be infinitely variable such that any number of positions between flow passing, flow blocking and drain positions may be achievable. Spool 44 may be actuated by a solenoid 48, or by other means of actuation known in the art. In the depicted embodiment, the actuation force of the solenoids 48 may be opposed by a springs 54.

Figure 4:
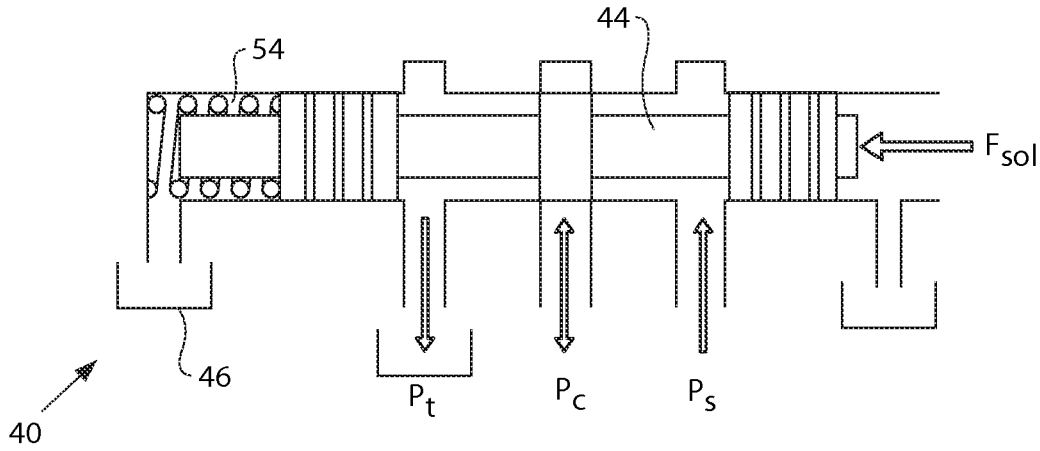
FIG. 4 is a schematic illustration of an exemplary valve in a flow blocking position.
Figure 5:
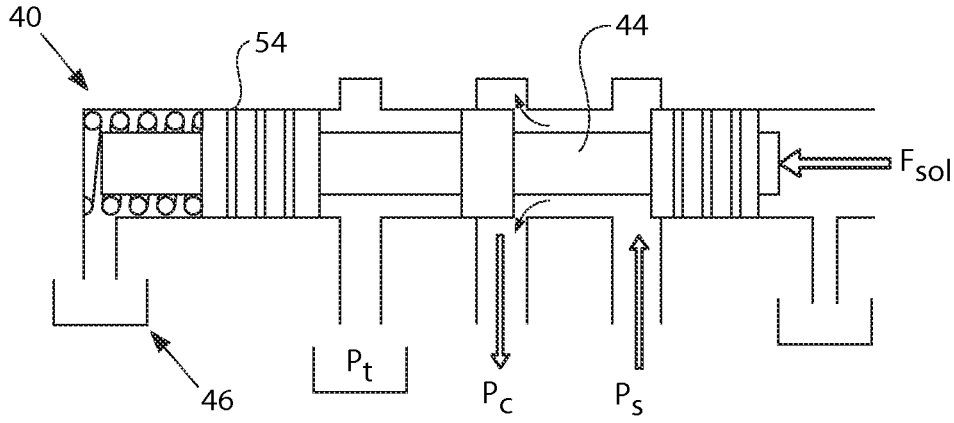
FIG. 5 is a schematic illustration of an exemplary valve in a flow passing position.
Figure 6:
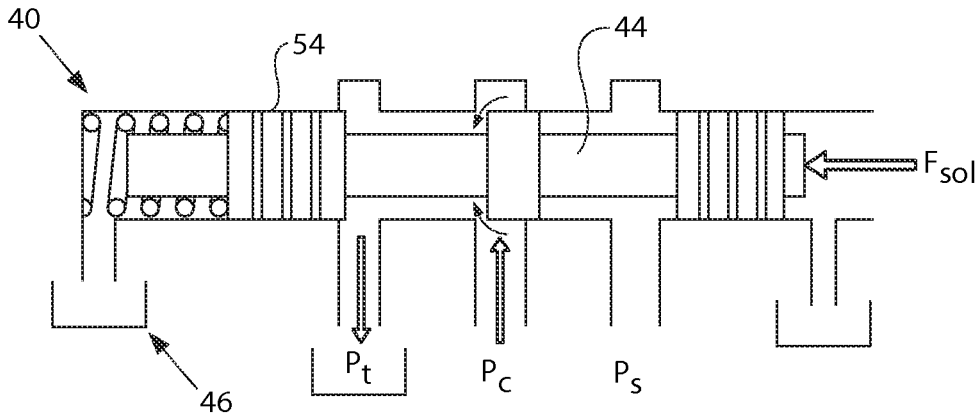
FIG. 6 is a schematic illustration of an exemplary valve in a drain position.

FIG. 4 illustrates a control valve 40, 42 at a flow blocking position. As illustrated, when the spool 44 is in a flow blocking position, fluid is substantially prevented both from passing from the charge pump 28 to the respective control actuator 36, 38, and from passing from the respective control actuator 36, 38 to the tank 46. In FIGS. 4-6, $P_T$ represents the hydraulic pressure in a line communicating with tank 46, $P_S$ represents the hydraulic pressure in a line communicating with charge pump 28, and $P_C$ represents the hydraulic pressure in a line communicating with a control actuator 36, 38. The steady state force balance on the spool can be calculated from Equation 1 below.

$$F_{sol,0}=k_{sprg}(x_0+\delta_{precomp}) \tag{1}$$

In Equation 1, $F_{sol,0}$ is the solenoid 48 force; $k_{sprg}$ is the spring rate; $\delta_{precomp}$ is the spring pre-compression with zero solenoid 48 force; and $x_0$ is the spool displacement at the flow blocking position. The force of the solenoid 48 can generally be expressed according to Equation 2 below.

$$F_{sol,0}=k_{is}i_{bias} \tag{2}$$

In Equation 2, $k_{is}$ is the steady state solenoid 48 current-force gain and $i_{bias}$ is the solenoid 48 current. Accordingly, where Equation 2 holds true, the steady state solenoid 48 current, i.e. bias current, to maintain a flow blocking position can be calculated according to Equation 3 below.

$$i_{bias} = \frac{k_{sprg}}{k_{is}}(x_0 + \delta_{precomp}) \tag{3}$$

FIG. 5 illustrates a control valve 40, 42 in a flow passing position. The solenoid 48 force, in this flow passing position may be described according to Equation 4 below.

$$F_{sol}=k_{sprg}(\Delta x+x_0+\delta_{precomp})+C_{ff}A(\Delta x)(P_s-P_c) \tag{4}$$

In Equation 4, $\Delta x$ is the spool 44 displacement from its flow blocking position; $C_{ff}$ is the valve flow force coefficient; and A is the valve metering area, which is spool 44 position dependent. Combining Equations 1-4, $i_{sol}$ may be expressed according to Equation 5 below.

$$\begin{aligned} i_{sol} &= i_{bias} + \Delta i_{sol} \\ &= \frac{k_{sprg}}{k_{is}}(x_0 + \delta_{precomp}) + \frac{(k_{sprg}\Delta x + C_{ff}A(\Delta x)(P_s - P_c))}{k_{is}} \end{aligned} \tag{5}$$

FIG. 6 illustrates a control valve 40, 42 in a drain position, in which fluid is allowed to flow from a control actuator 36, 38 to tank 46. In this case, the steady state flow force is working against the spring 54, instead of against the solenoid 48 as in the case of a fluid passing position. Therefore, we can obtain the steady state solenoid current as expressed in Equation (6) below.

$$\begin{aligned} i_{sol} &= i_{bias} + \Delta i_{sol} \\ &= \frac{k_{sprg}}{k_{is}}(x_0 + \delta_{precomp}) + \frac{(k_{sprg}\Delta x - C_{ff}A(\Delta x)(P_s - P_c))}{k_{is}} \end{aligned} \tag{6}$$

The two control valves 40, 42 may be corresponding controlled around their flow blocking positions. The use of two three-way flow control valves for control valves 40, 42 provides a great amount of flexibility to match the flow metering requirements. For a closed loop feedback control, the control currents for the two solenoids 48 may be expressed according to Equations (7) and (8) below.

$$i_{sol1}=i_{bias1}+f_1(\Delta e) \tag{7}$$

$$i_{sol2}=i_{bias2}-f_2(\Delta e) \tag{8}$$

where $f_1(\Delta e)$ and $f_2(\Delta e)$ are control efforts calculated by an applied control law, which may be tracking error dependent. A number of stable control algorithms known in the art may be used to determine $f_1(\Delta e)$ and $f_2(\Delta e)$.

Due to leakage in the control actuators 36, 38, the flow blocking position may be altered toward a flow passing position to maintain the swashplate 32 in a steady state position. As such, the corresponding solenoid 48 current used to maintain a stead state swashplate position may be increased from the solenoid 48 bias current given by Equation 3. Assuming the leakage is in the form of laminar flow, the stead state solenoid 48 current may be linearly dependent on the pressure of the fluid in the control actuators 36, 38 and inversely dependent on the fluid viscosity. Pressure sensors may be provided to monitor the pressure of the fluid in the control actuators 36, 38 to assist in the determination of steady state solenoid 48 currents.

INDUSTRIAL APPLICABILITY

The control hardware 30 discussed above may be utilized in any number of hydraulic systems, such as, for example, systems designed to provide power to implements 14, hydraulic transmissions 20, or hybrid transmissions utilizing hydraulic power. With reference to FIG. 3, an increase in pump 22 displacement may be effected by increasing the swashplate angle α. This may be accomplished by actuating control valve 42 to a flow passing position and control valve 40 to a drain position. Conversely, pump 22 displacement may be decreased by actuating control valve 42 to a drain position and control valve 40 to a flow passing position.

If pump 22 is an over center pump, as illustrated in FIG. 3, the swashplate angle α may be made negative, in which case the pump 22 may act as a motor. This may be done, for example, to retard motion in a hydraulic transmission 20, in which case power generated by the pump may, for example, be fed back into a drive train, stored, used for other purposes, or simply dissipated as heat.

Once a desired pump 22 displacement, i.e. swashplate angle α, is achieved, the control valves 40, 42 may be configured to maintain a steady state swashplate angle α, as described above.

It will be apparent to those skilled in the art that various modifications and variations can be made to the disclosed apparatus and control methodology without departing from the scope or spirit of the disclosure. Additionally, other embodiments of the disclosed apparatus and control methodology will be apparent to those skilled in the art from consideration of the specification and practice of the apparatus and method disclosed herein. It is intended that the specification and examples be considered as exemplary only.

What is claimed is:

1. A hydraulic system comprising: a variable displacement hydraulic pump having a swashplate rotatable about an axis; a first hydraulic actuator configured to rotate the swashplate a first direction about the axis; a second hydraulic actuator configured to rotate the swashplate a second direction about the axis; the second direction being opposite to the first direction; a first flow control valve configured to provide pressurized fluid to the first actuator and to selectively drain fluid from the first control actuator to a tank, wherein the first flow control valve is selectively actuated by a solenoid; and a second flow control valve configured to provide pressurized fluid to the second actuator and to selectively drain fluid from the second control actuator to the tank, wherein the second flow control valve is selectively actuated by a solenoid such that the variable displacement hydraulic pump may be maintained in a steady-state configuration by directing pressurized fluid through the first flow control valve to the first actuator and moving the second flow control valve to a flow blocking position to substantially hydraulically isolate the second actuator.

2. The hydraulic system of claim 1, wherein the first flow control valve is movable between a first position passing pressurized fluid to the first hydraulic actuator, a second position substantially hydraulically isolating the first hydraulic actuator, and a third position draining pressurized fluid from the first hydraulic actuator to the tank.

3. The hydraulic system of claim 1, wherein the second flow control valve is movable between a first position passing pressurized fluid to the second hydraulic actuator, a second position substantially hydraulically isolating the second hydraulic actuator, and a third position draining pressurized fluid from the second hydraulic actuator to the tank.

4. The hydraulic system of claim 1, wherein the variable displacement hydraulic pump is an over-center pump.

5. The hydraulic system of claim 1 further including a charge pump, wherein the charge pump provides pressurized fluid to the first control valve and the second control valve.

6. The hydraulic system of claim 1 further including a hydraulic motor, wherein the variable displacement hydraulic pump provides pressurized fluid to the hydraulic motor.

7. The hydraulic system of claim 6, wherein the hydraulic motor provides power to a traction device.

8. A machine comprising: an engine; a variable displacement hydraulic pump powered by the engine and having a swashplate rotatable about an axis; a first hydraulic actuator configured to rotate the swashplate a first direction about the axis; a second hydraulic actuator configured to rotate the swashplate a second direction about the axis; the second direction being opposite to the first direction; a first flow control valve configured to provide pressurized fluid to the first actuator and to selectively drain fluid from the first hydraulic actuator to a tank; and a second flow control valve configured to provide pressurized fluid to the second hydraulic actuator and to selectively drain fluid from the second hydraulic actuator to the tank, wherein the first and second flow control valves are actuated by respective first and second solenoids such that the variable displacement hydraulic pump may be maintained in a steady-state configuration by directing pressurized fluid through the first flow control valve to the first hydraulic actuator and moving the second flow control valve to a flow blocking position to substantially hydraulically isolate the second hydraulic actuator.

9. The machine of claim 8, wherein the first flow control valve is movable between a first position passing pressurized fluid to the first hydraulic actuator, a second position substantially hydraulically isolating the first hydraulic actuator, and a third position draining pressurized fluid from the first hydraulic actuator to the tank.

10. The machine of claim 8, wherein the second flow control valve is movable between a first position passing pressurized fluid to the second hydraulic actuator, a second position substantially hydraulically isolating the second hydraulic actuator, and a third position draining pressurized fluid from the second hydraulic actuator to the tank.

11. The machine of claim 8, wherein the variable displacement pump is an over-center pump.

12. The machine of claim 11, further comprising a hydraulic motor, wherein the hydraulic motor receives pressurized fluid from the variable displacement hydraulic pump.

13. The machine of claim 12, further comprising a traction device, wherein the traction device receives mechanical power from the hydraulic motor.

14. The machine of claim 13, wherein the traction device is one of a wheel or a track.

15. A method for controlling an orientation of a swashplate of a variable displacement hydraulic device comprising the steps:

Step 1: configuring the variable displacement hydraulic device to act as a pump by directing pressurized fluid through a first flow control valve to a first control actuator to create a moment in a first direction on the swashplate, the first flow control valve also being adapted to selectively drain fluid from the first control actuator to a tank, wherein the first flow control valve is actuated by a first solenoid;

Step 2: configuring the variable displacement hydraulic device to act as a motor by directing pressurized fluid through a second flow control valve to a second control actuator to create a moment in a second direction on the swashplate, the second direction being opposite to the first direction, the second flow control valve also being adapted to selectively drain fluid from the second control actuator to the tank, wherein the second flow control valve is actuated by a second solenoid, and Step 3: maintaining the variable displacement hydraulic device in a steady-state configuration by directing pressurized fluid through the first control valve to the first control actuator and moving the second control valve to a flow blocking position to substantially hydraulically isolate the second control actuator.

* * * * *